US010899028B2

(12) United States Patent
Park et al.

(10) Patent No.: US 10,899,028 B2
(45) Date of Patent: Jan. 26, 2021

(54) UNITARY RAZOR CARTRIDGE AND METHOD FOR ASSEMBLING THE SAME

(71) Applicant: DORCO CO., LTD., Seoul (KR)

(72) Inventors: Young Ho Park, Seoul (KR); Jae Joon Lee, Seoul (KR); Sung Hee Son, Seoul (KR); Shin Hwan Park, Seoul (KR); Sang Hun Park, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/463,743

(22) PCT Filed: Jun. 13, 2017

(86) PCT No.: PCT/KR2017/006131
§ 371 (c)(1),
(2) Date: May 23, 2019

(87) PCT Pub. No.: WO2018/097434
PCT Pub. Date: May 31, 2018

(65) Prior Publication Data

US 2019/0381681 A1 Dec. 19, 2019

(30) Foreign Application Priority Data

Nov. 24, 2016 (KR) ..... 10-2016-0157193

(51) Int. Cl.
*B26B 21/40* (2006.01)
*B26B 21/14* (2006.01)

(52) U.S. Cl.
CPC ..... *B26B 21/4012* (2013.01); *B26B 21/14* (2013.01); *B26B 21/4025* (2013.01); *B26B 21/4018* (2013.01)

(58) Field of Classification Search
CPC ..... B26B 21/4018; B26B 21/4025; B26B 21/4068; B26B 21/443; B26B 21/00;
(Continued)

(56) References Cited

U.S. PATENT DOCUMENTS 1,901,830 A 3/1933 Gaisman
4,439,920 A 4/1984 Nauheimer
(Continued)

FOREIGN PATENT DOCUMENTS

EP 0290025 11/1998
EP 0878275 11/1998
(Continued)

OTHER PUBLICATIONS

European Patent Office Application Serial No. 17874433.0, Search Report dated Nov. 11, 2019, 8 pages.
(Continued)

*Primary Examiner* — Jason Daniel Prone
(74) *Attorney, Agent, or Firm* — Lee, Hong, Degerman, Kang & Waimey

(57) ABSTRACT

A razor cartridge and a method for assembling a razor cartridge are disclosed. A razor cartridge includes: a blade housing including a seat configured to receive at least one blade; a pair of side caps respectively disposed at opposite ends of the blade housing, wherein each side cap is configured to be engaged with a corresponding end of the blade housing; and a plurality of bridges, wherein one or more bridges are disposed at each end of the blade housing and configured to provide a moveable connection between the side cap and the corresponding end of the blade housing, wherein the blade housing, the pair of side caps, and the one or more bridges are integrally formed, and wherein each side cap is configured to secure the at least one blade to the blade housing when the side cap is engaged with the corresponding end of the blade housing.

7 Claims, 9 Drawing Sheets

(58) Field of Classification Search
CPC ..... B26B 21/08; B26B 21/10; B26B 21/14; B26B 21/16; B26B 21/22; B26B 21/222; B26B 21/40; B26B 21/4012–4025
USPC ..... 30/346.57, 350, 353, 346.58, 509, 514, 30/47–51
See application file for complete search history.

(56) References Cited

U.S. PATENT DOCUMENTS 4,488,357 A * 12/1984 Jacobson ..... B26B 21/225 30/527
5,067,238 A * 11/1991 Miller ..... B26B 21/227 30/34.2
5,224,267 A * 7/1993 Simms ..... B26B 21/4068 30/50
5,369,885 A * 12/1994 Ferraro ..... B26B 21/227 30/41
5,410,810 A * 5/1995 Gillibrand ..... B26B 21/4025 30/41
5,416,974 A * 5/1995 Wain ..... B26B 21/227 30/50
5,661,907 A * 9/1997 Apprille, Jr. ..... B26B 21/225 30/47
5,687,485 A 11/1997 Shurtleff et al.
5,761,814 A * 6/1998 Anderson ..... B26B 21/4068 30/50
5,956,848 A 9/1999 Tseng et al.
5,956,851 A 9/1999 Apprille et al.
6,009,624 A * 1/2000 Apprille, Jr. ..... B26B 21/227 30/50
6,041,926 A 3/2000 Petricca et al.
6,044,542 A * 4/2000 Apprille, Jr. ..... B26B 21/227 29/509
6,052,903 A 4/2000 Metcalf et al.
RE36,816 E * 8/2000 Apprille, Jr. ..... B26B 21/4018 30/34.2
6,161,287 A * 12/2000 Swanson ..... B26B 21/4018 30/50
6,185,822 B1 2/2001 Tseng et al.
6,212,777 B1 4/2001 Gilder et al.
6,305,084 B1 * 10/2001 Zucker ..... B26B 21/22 30/50
6,397,473 B1 * 6/2002 Clark ..... B26B 21/227 30/50
6,442,839 B1 9/2002 Tseng et al.
6,516,518 B1 2/2003 Garraway et al.
6,612,040 B2 9/2003 Gilder
6,671,961 B1 * 1/2004 Santhagens Van Eibergen ..... B26B 21/227 30/50
6,684,513 B1 2/2004 Clipstone et al.
6,941,659 B2 * 9/2005 Gilder ..... B26B 21/4018 30/50
7,024,776 B2 * 4/2006 Wain ..... B26B 21/227 30/50
7,178,241 B1 * 2/2007 Cummings ..... B26B 21/446 30/41
7,469,477 B2 * 12/2008 Coffin ..... B26B 21/222 30/50
7,610,683 B2 * 11/2009 Brown ..... B26B 21/00 30/50
7,748,121 B2 * 7/2010 Coffin ..... B26B 21/565 30/47
8,336,212 B2 * 12/2012 Bozikis ..... B26B 21/227 30/50
8,590,162 B2 * 11/2013 Park ..... B26B 21/225 30/50
9,440,365 B2 * 9/2016 Park ..... B26B 21/38
9,539,734 B1 * 1/2017 Bozikis ..... B26B 21/227
9,604,373 B2 * 3/2017 Park ..... B26B 21/225
9,630,330 B2 * 4/2017 Ntavos ..... B26B 21/4012
9,878,458 B2 * 1/2018 Park ..... B26B 21/565
10,391,652 B2 * 8/2019 Bruno ..... B26B 21/222
10,639,806 B2 * 5/2020 Bozikis ..... B26B 21/4012
10,723,031 B2 * 7/2020 Park ..... B26B 21/4018
2003/0159291 A1 8/2003 Gregory
2003/0208907 A1 * 11/2003 Brown, Jr. ..... B26B 21/4068 30/50
2005/0223568 A1 * 10/2005 Walker ..... B26B 21/4043 30/346.57
2006/0162167 A1 * 7/2006 Walker ..... B26B 21/521 30/34.2
2006/0196054 A1 * 9/2006 Luxton ..... B26B 21/4018 30/50
2007/0289139 A1 * 12/2007 Peyser ..... B26B 21/225 30/47
2008/0229583 A1 * 9/2008 Fischer ..... B26B 21/4018 30/34.2
2009/0113715 A1 * 5/2009 Goss-Melendez ..... B26B 21/40 30/50
2009/0188112 A1 * 7/2009 Prochaska ..... B26B 21/4012 30/34.05
2011/0203120 A1 * 8/2011 Witkus ..... B26B 21/222 30/346.58
2011/0232101 A1 * 9/2011 Park ..... B26B 21/4018 30/50
2011/0289779 A1 * 12/2011 Volodin ..... B26B 21/227 30/50
2013/0205595 A1 * 8/2013 Bykowski ..... B26B 21/4012 30/64
2016/0129603 A1 * 5/2016 Antoniou ..... B26B 21/4081 30/50
2016/0236364 A1 * 8/2016 Varenberg ..... B26B 21/4018
2018/0236676 A1 * 8/2018 Ren ..... B26B 21/4012
2019/0047164 A1 * 2/2019 Lee ..... B26B 21/40
2019/0047165 A1 * 2/2019 Gegg ..... B26B 21/4062
2019/0160698 A1 * 5/2019 Efthimiadis ..... B26B 21/4012
2019/0283265 A1 * 9/2019 Efthimiadis ..... B26B 21/227
2019/0299457 A1 * 10/2019 Long ..... B26B 21/4012
2019/0315006 A1 * 10/2019 Park ..... B26B 19/12
2020/0269453 A1 * 8/2020 Hahn ..... B26B 21/16

FOREIGN PATENT DOCUMENTS

EP 3546158 A4 * 12/2019 ..... B26B 21/4025
KR 1020110090249 8/2011
KR 20130053876 A * 5/2013 ..... B26B 21/40
KR 20140120071 A * 10/2014 ..... B26B 21/40
WO 94/11163 5/1994
WO 2013122900 8/2013

OTHER PUBLICATIONS

PCT International Application No. PCT/KR2017/006131, International Search Report dated Aug. 25, 2017, 4 pages.
State Intellectual Property Office of the People's Republic of China Application Serial No. 201780058110.5, Office Action dated Mar. 20, 2020, 4 pages.

* cited by examiner

UNITARY RAZOR CARTRIDGE AND METHOD FOR ASSEMBLING THE SAME

CROSS-REFERENCE TO RELATED APPLICATIONS

This application is the National Stage filing under 35 U.S.C. 371 of International Application No. PCT/KR2017/006131, filed on Jun. 13, 2017, which claims the benefit of earlier filing date and right of priority to Korean Application No. 10-2016-0157193, filed on Nov. 24, 2016, the contents of which are all hereby incorporated by reference herein in their entirety.

TECHNICAL FIELD

The present disclosure relates to a razor cartridge and more particularly to an integral razor cartridge in which all components thereof, except for blades, are integrally constructed and injection molded to simplify a manufacturing and assembling process thereof.

BACKGROUND

A typical razor cartridge includes one or more blades and a blade housing including a blade seat on which the blades are placed. The blades are placed on the blade seat, and parts for securing the blades which wrap around the sides of the blade housing are assembled, resulting in a single razor cartridge.

Here, as a part for wrapping the blades, a clip made of aluminum is generally used to prevent the blades from being misplaced or dislocated from the cartridge.

The blades are made of a metal while the blade housing is made of plastics and other materials in a separate process to reduce the weight and the cost. The separately produced blades and blade housing are assembled to produce a razor cartridge.

The components of the blade housing (blade seating and blade wrapping components) are also typically produced through a separate assembly process. Thus, razor cartridges are produced through a stepwise manufacturing process.

However, the aluminum clips used as a blade wrapping component, as a consequence of its lightness and diminutive size, is difficult to manufacture and supply in mass for the assembly process.

In addition, as a consequence of being produced by undergoing a number of assembly processes, including the molding process, there exist a possibility of the blade housing being unable to securely fix the blades thereto.

In addition, since not a single, but a plurality of blades are involved, the clip surface alone may not be able to control all the blades, preventing the blades from being fixed individually and adaptively.

Further, when the blades are wrapped using the aluminum clip, the blades are supposed to be inserted and bent into fixed positions, wherein a deviation of the bending position or the bending force from the optimum condition hinders the blades from being fixed sufficiently and strongly.

DISCLOSURE

Technical Problem

The present disclosure in some embodiments seeks to integrally form a razor cartridge excluding the blades to simplify the razor manufacturing process, and to find a method for simplifying the assembly process of the blades and the blade housing such that defects are reduced during the assembly process.

The problems of the present disclosure are not limited to those mentioned above, and other unmentioned problems can be clearly understood by those skilled in the art from the following description.

SUMMARY

At least one aspect of the present disclosure provides a razor blade including at least one blade; a blade housing including a seat into which the at least one blade is inserted; a pair of side caps spaced apart from each other, each cap positioned at a different side of the blade housing; and bridges configured to connect the blade housing and the pair of side caps, wherein the blade housing, the pair of side caps, and the bridges are integrally formed, and wherein the at least one blade is securely seated in the seat of the blade housing by the pair of side caps secured to the blade housing when the pair of side caps and the bridges are moved closer to the blade housing.

Another aspect of the present disclosure provides a method of assembling a razor blade, including providing a razor cartridge of a unitary structure having a blade housing, a pair of side caps disposed on longitudinal ends of the blade housing, and bridges for interconnecting the blade housing and the side caps, wherein the blade housing includes one or more seats into which one or more blades are to be inserted, and wherein one side cap is disposed on one longitudinal end of the blade housing and another side cap is disposed on another longitudinal end of the blade housing; providing and seating the one or more blades in the seat; and moving the pair of side caps closer to the blade housing until the pair of side caps are secured to the blade housing such that the one or more blades are securely seated in the seat of the blade housing and at least a portion of edges of the one or more blades are covered by the pair of side caps.

The details of other embodiments are included in the detailed description and drawings.

Advantageous Effects

The embodiments of the present disclosure have at least the following effects.

A blade housing, side caps and a bridge which constitute the razor cartridge are injection molded at one time, thereby simplifying the manufacturing process.

Pressing in the side caps alone can fix blades to the blade housing, thereby simplifying the assembling process and reducing the process defect rate.

In addition, pressing of the side caps causes contractional deformation of the bridge, transmitting the stress to the blade housing and the side caps, allowing further strengthening of the coupling between the side caps and the blade housing.

The effects according to the present disclosure are not limited by the contents exemplified above, and more various effects are included in the specification. Other effects not mentioned may be clearly understood by those skilled in the art from the description of the claims.

DETAILED DESCRIPTION

Figure 1:
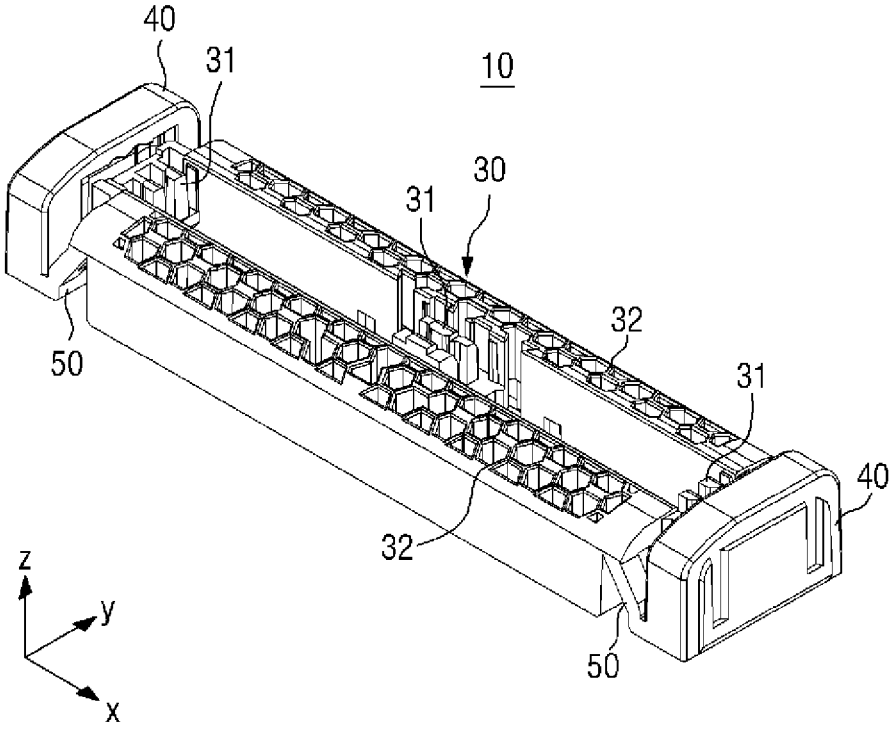
FIG. 1 is a perspective view of a razor cartridge according to at least one embodiment of the present disclosure prior to coupling of one or more blades to the razor cartridge.

The advantages and features of the present disclosure and the manner of achieving them will become apparent with reference to the embodiments described in detail below with reference to the accompanying drawings. The present disclosure may, however, be embodied in many different forms and should not be construed as limited to the embodiments set forth herein. Rather, these embodiments are provided so that this disclosure will be thorough and complete, and to fully disclose the scope of the disclosure to those skilled in the art. The disclosure is only defined by the scope of the claims. Like reference numerals designate like elements throughout the specification.

Unless defined otherwise, all terms (including technical and scientific terms) used herein may be used in a sense commonly understood by one of ordinary skill in the art to which this disclosure belongs. In addition, commonly used dictionary defined terms are not ideally or excessively interpreted unless explicitly defined otherwise.

The terminology used herein is for the purpose of illustrating embodiments and is not intended to be limiting of the present disclosure. In the present specification, a singular form of nouns includes their plural forms unless otherwise specified in the specification. Throughout this specification, when a part "comprises" and/or is "comprising" an element, present disclosure does not exclude the presence or addition of one or more other elements in addition to the stated element.

Further, the embodiments herein will be described with reference to cross-sectional views and/or schematic drawings that are ideal illustrations of the present disclosure. Thus, the shape of the illustrations may be modified by manufacturing techniques and/or tolerances. In addition, in the drawings of the present disclosure, each component may be somewhat enlarged or reduced in view of convenience of explanation. Like reference numerals refer to like elements throughout the specification, and the term "and/or" is intended to include each and every combination of one or more of the mentioned items.

Spatially relative terms should be understood in terms of the directions shown in the drawings, further including the different directions of components at the time of use or operation. The components can also be oriented in other directions, so that spatially relative terms can be interpreted according to orientation.

Hereinafter, the configuration of some embodiments of the present disclosure will be described in detail with reference to the accompanying drawings.

FIG. 1 is a perspective view of a razor cartridge 10 according to at least one embodiment of the present disclosure prior to coupling of one or more blades 20 thereto. Referring to FIG. 1, the razor cartridge 10 includes a blade housing 30 located centrally and having top surfaces 32, seats 31, the blades 20 to be inserted into the seats 31 of the blade housing 30, a pair of side caps 40, each disposed at each end of the blade housing 30, and bridges 50 for connecting the blade housing 30 and the pair of the side caps 40.

The blade housing 30, the pair of side caps 40, and the bridges 50 are integrally formed. In order to integrally form the blade housing 30, pair of side caps 40 and bridges 50, the embodiments utilize, for example, injection molding using a metal mold, extrusion molding, or the like. Other molding methods may also be used for integrally forming the components. In addition, the razor cartridge 10 may be produced by multi-component molding and the different materials and qualities of the materials used depend on structural features and locations within the integrally formed cartridge.

The vertical direction in the present disclosure means the z-axis direction shown in each figure. The upward direction means the direction the open side of the blade housing 30 faces, and the downward direction means the opposite direction of the upward direction.

The longitudinal orientation of the blade housing 30 refers to the x-axis direction shown in the drawings, and the breadthwise orientation of the blade housing 30 refers to the y-axis direction as illustrated.

Figure 2:
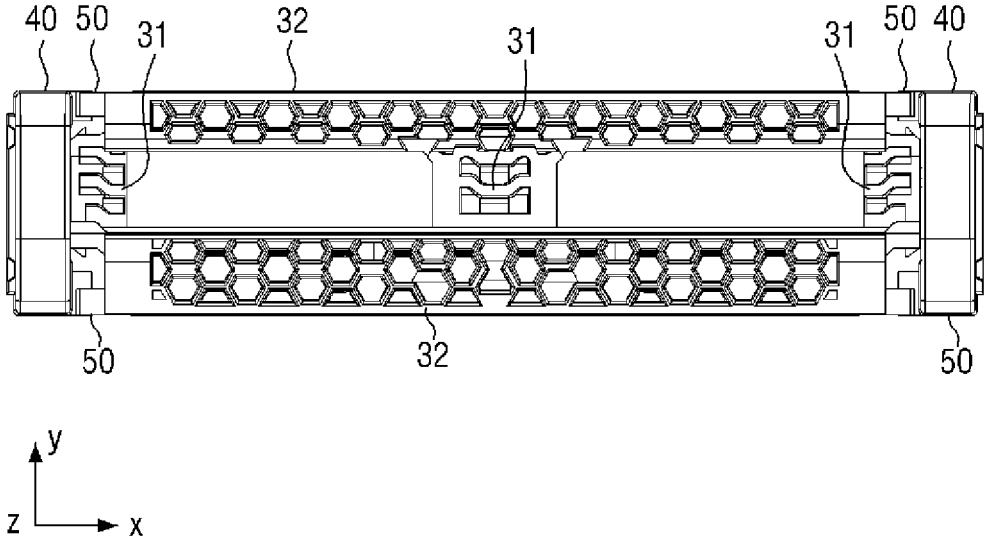
FIG. 2 is a plan view of a razor cartridge according to at least one embodiment of the present disclosure prior to coupling of one or more blades to the razor cartridge.
Figure 3:
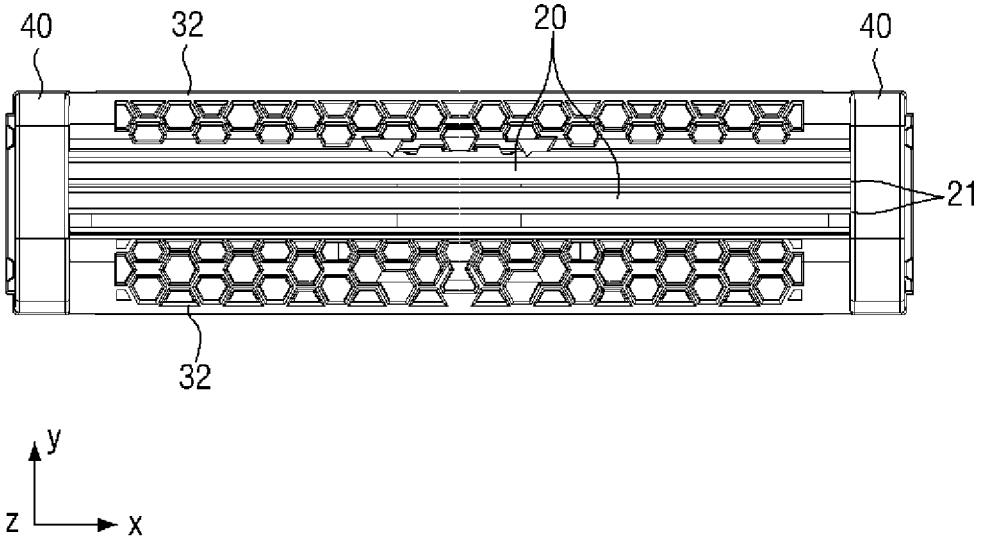
FIG. 3 is a plan view of a razor cartridge according to at least one embodiment of the present disclosure after coupling of the blades to the razor cartridge.
Figure 4:
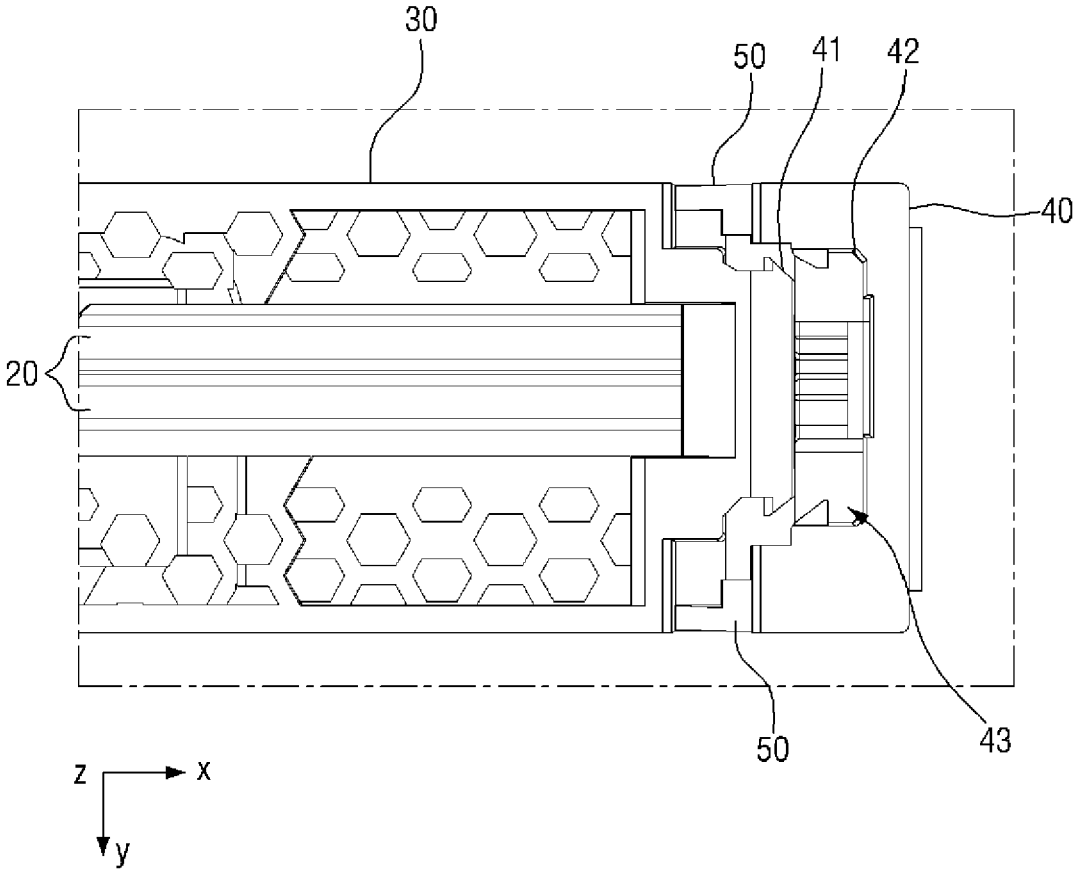
FIG. 4 is a rear view of a razor cartridge according to at least one embodiment of the present disclosure prior to coupling of the side caps and the blade housing to the razor cartridge.

The following describes a mode in which at least one or more blades 20 are seated on the razor cartridge 10 according to at least one embodiment of the present disclosure with reference to FIGS. 2 to 4.

FIG. 2 is a plan view of the razor cartridge 10 according to at least one embodiment of the present disclosure prior to coupling of the blades 20 thereto, and FIG. 3 is a plan view of the razor cartridge 10 according to at least one embodiment of the present disclosure after coupling of the blades 20 thereto.

For the blade 20 to be coupled to the razor cartridge 10 in some of the embodiments, a blade formed by bending a planar material having a cutting edge may be used. Alternatively, a razor blade employed may be an unbent flat blade or a blade made of a bent support with a bladed member welded thereto on its upper surface. The blade 20 is generally made of a metal, in particular, stainless steel. However, the present disclosure is not limited to this, and any material such as ceramics, plastic, or the like can be used as the material of the blade 20 as long as it has a predetermined strength to withstand the commensurate forces.

The blade housing 30 is a part serving as the main skeleton of the entire razor cartridge 10 and is elongated in one direction. The blade housing 30 has opposite longitudinal ends, each being formed with the first coupling portions 41 to be coupled to the second coupling portions 42 to be described below in the description of the side cap 40.

As a material constituting the blade housing 30, a synthetic resin, such as plastic, is generally used, but the present disclosure is not limited thereto.

The blade housing 30 has top surfaces 32 such that the blades 20 are located between the top surfaces and the top surfaces contact the skin when shaving is performed. Accordingly, both of the top surfaces 32 may be provided with a guard for helping body/facial hair alignment during the cutting, a comb guard, a lubrication band for protecting the skin during the cutting and a soap portion. The top surfaces 32 may have a honeycomb structure formed with a plurality of hexagonal through holes facilitating the guard function, expulsion of shaving residue, and cleaning, although the through holes are not limited to a hexagonal shape. The configuration of the top surfaces 32 at both breadthwise ends of the blade housing 30 is not limited to the illustration herein. Embodiments in which the lubrication band and the guard are formed on the top surfaces 32 will be described below in detail referring to FIG. 11.

The breadthwise center of the blade housing 30 has an open top surface. The blade housing 30 has a bottom breadthwise center provided with the seats 31 on which the blades 20 are fixed when they are inserted into the blade housing 30. The seats 31 are not necessarily formed over the entire bottom surface of the blade housing 30, as long as they are of a sufficient length to allow the blades 20 to get fixed without being detached from the blade housing 30 during the cutting. Therefore, for example, as shown in FIGS. 1 and 2, the seats 31 may be positioned at both longitudinal ends of the blade housing 30 and in the longitudinal center thereof. The method of disposing the seats 31 is not limited to this, and they may be disposed in some embodiments at four positions at equal intervals along the longitudinal direction of the blade housing 30.

Illustrated embodiments have two blades 20 and two pairs of seats 31 disposed breadthwise of the blade housing 30, although the blades 20 and the seats 31 are not limited to that number. At least one or more blades 20 can be provided, and the number of the seats 31 is determined by the number of the blades 20 to be joined. Therefore, there may be one blade 20 or a plurality of the blades 20 may constitute a single unit of the blades 20.

As shown in FIG. 1, the pair of side caps 40 are arranged at a certain clearance from both longitudinal ends of the blade housing 30. Inner surfaces of the side caps 40 are configured to cover the outer edges of both longitudinal ends of the blade housing 30, which the side caps 40 face. The inner surfaces the side cap may include a side cap recess 43. The side cap recess may be positioned at the inner surface and defined by two side surfaces of the inner surface, which are located at either side of the side cap recess 43, and a top end of the inner surface located above the side cap recess 43.

Therefore, when a side cap 40 is viewed from the blade housing 30, the side cap 40 may have a horseshoe, or inverted "U" shape, where both side surfaces and the top end of the inner surface are extended toward the blade housing 30. This provides concavity to the side cap recess 43, located relatively far from the blade housing 30. However, the shape of the side cap recess 43 is not limited to the illustration as above, and the side cap recess 43 may have various other shapes for accommodating an end of the blade housing 30. For example, the side cap recess 43 may have a square shape having the side cap recess in the middle of the square shape, instead of the horseshoe or inverted "U" shape by including a bottom end of the inner surface extending between the side surfaces, where the bottom end also extends toward the blade housing 30.

The second coupling portions 42 are disposed in the side caps 40 on the surface facing the blade housing 30 so as to allow them to be engaged with the first coupling portions 41 disposed at both longitudinal ends of the blade housing 30 described above. Therefore, in order to be coupled to each other, the first coupling portions 41 and the second coupling portions 42 may have mutually complementary contours.

The outer lateral surface of the side cap 40 is a portion to which an external force is applied during the assembling of the razor cartridge to be described later. Therefore, a jagged or textured surface may be provided to the outer lateral surface of the side cap 40 to provide secure contact between the lateral surface and an object used to apply an external force and prevent slippage.

In at least one embodiment of the present disclosure, the blade housing 30 and the side cap 40 are integrally produced. To provide the pair of side caps 40 with a predetermined clearance maintained from the blade housing 30, there is a need for an interconnection, similar to bridges 50 to be described below.

The bridges 50 are each structured to connect one end of the side cap 40 to one end of the blade housing 30. In some embodiments, a lower end of the side cap 40 and an upper end of the blade housing 30 are connected to each other. In some embodiments, the side cap 40 is arranged to be disposed at a predetermined clearance with the blade housing 30, allowing the bridges 50 to be formed diagonally toward the lower side of the blade housing 30, respectively. Each bridge 50 is oriented in one of the directions excluding the direction perpendicular to the surface where the blade housing 30 comes in contact with the skin, i.e., excluding the z-axis direction. However, the shape and position of the bridges 50 are not limited thereto.

Two bridges 50 are located at each longitudinal end of the blade housing 30 to connect a corresponding side cap 40 to the blade housing 30. A first pair of bridges 50 may be located at a first longitudinal end of the blade housing 30 and a second pair of bridges 50 may be located at an opposite second longitudinal end of the blade housing 30. Thus, one blade housing 30 may have two pairs of bridges 50. In other words, a total of four bridges 50 are disposed. However, the number of bridges 50 is not limited to this, and other variations are possible, including one bridge at each longitudinal end, or more than two bridges at each longitudinal end.

Figure 5:
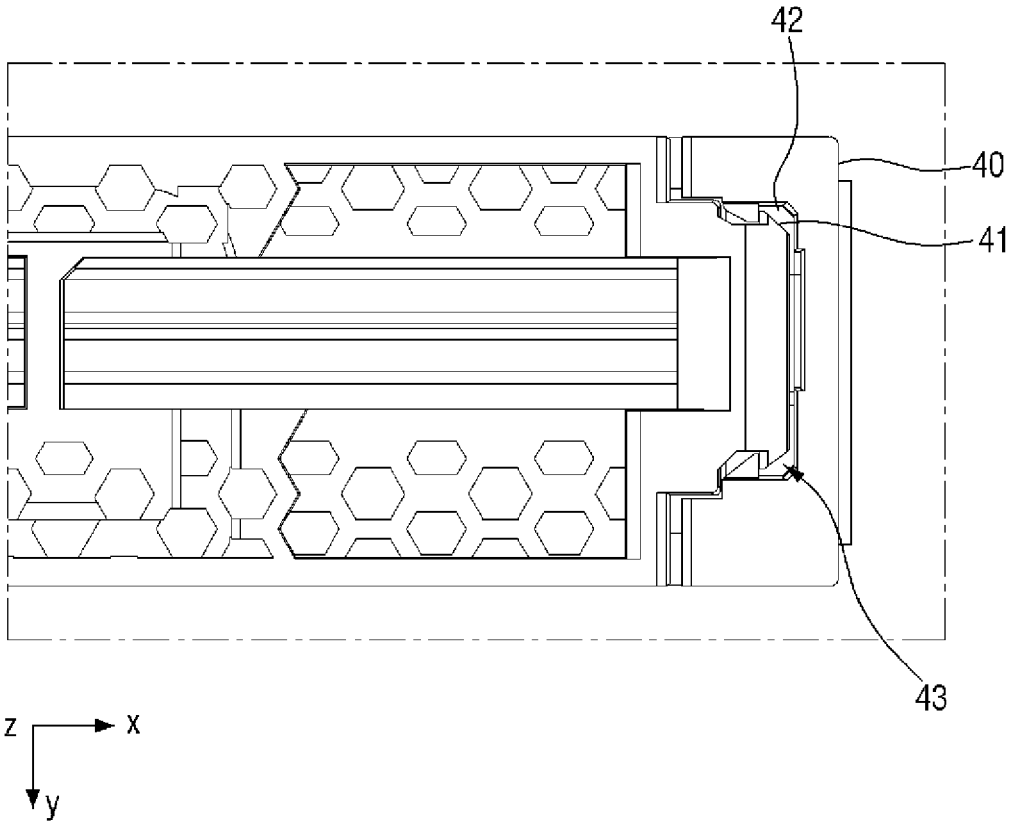
FIG. 5 is a rear view of a razor cartridge according to at least one embodiment of the present disclosure after coupling of the side caps and the blade housing to the razor cartridge.
Figure 6:
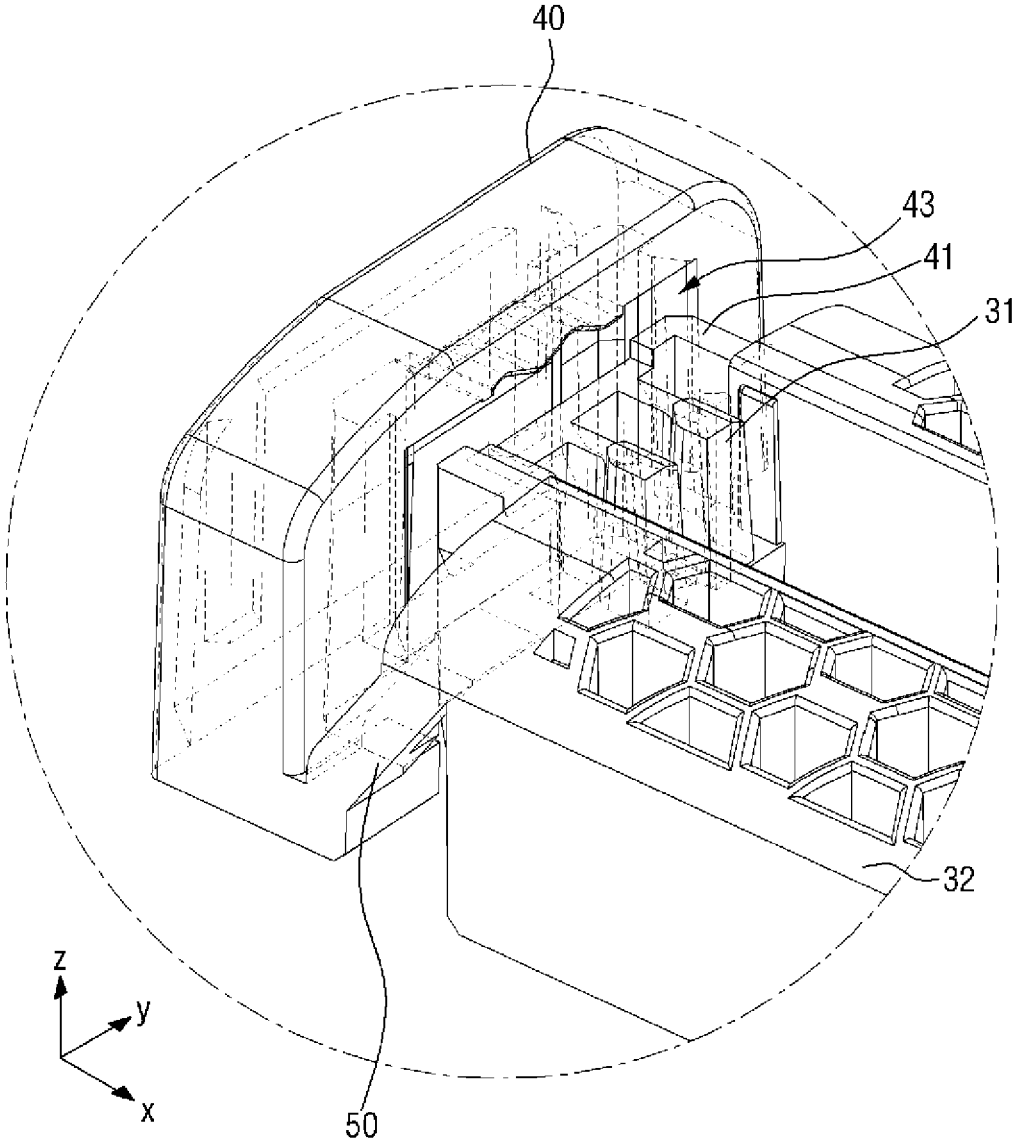
FIG. 6 is an enlarged perspective view of inside and outside of one end of the razor cartridge according to at least one embodiment of the present disclosure.
Figure 7:
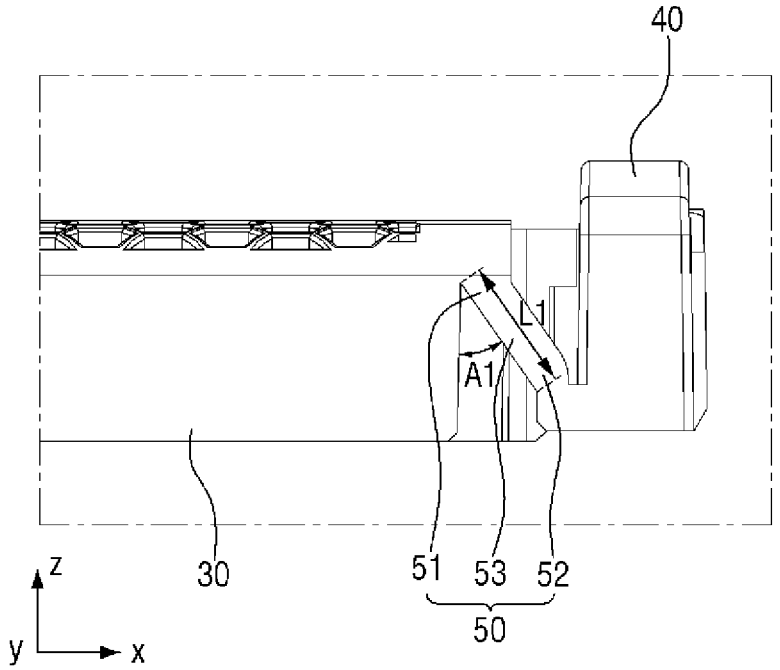
FIG. 7 is a side view of a razor cartridge according to at least one embodiment of the present disclosure prior to coupling of the side caps and the blade housing to the razor cartridge.

An example of a bridge 50, as shown in FIG. 7, includes a first junction 51 connected to the blade housing 30, a body 53, and a second junction 52 connected to the side cap 40. Referring to FIGS. 4, 5 and 6, the following describes a process of fastening the blades 20 to the cartridge according to at least one embodiment of the present disclosure through coupling of the blade housing 30 and the side caps 40.

FIG. 4 is a rear view of the razor cartridge 10 according to at least one embodiment of the present disclosure prior to coupling of the side caps 40 and the blade housing 30. FIG. 5 is a rear view of the razor cartridge 10 according to at least one embodiment of the present disclosure after the side caps 40 and the blade housing 30 are coupled. FIG. 6 is an enlarged perspective view of the inside and outside of one end of a razor cartridge according to at least one embodiment of the present disclosure.

The side cap 40 is pressed toward the blade housing 30, allowing the side cap 40 to move toward the center of the blade housing 30.

The blade housing 30 is formed on its opposite longitudinal ends with first coupling portions 41 facing the side cap 40, while the side caps 40 are formed with second coupling portions 42 facing the blade housing 30. The first coupling portions 41 are shaped complementary to the second coupling portions 42 so that, when the side caps 40 move toward the blade housing 30, the first and second coupling portions 41 and 42 are coupled to each other, thereby fixing the side caps 40 to both longitudinal ends of the blade housing 30.

In some embodiments, the first coupling portion 41 may include a protrusion and the second coupling portion 42 may include a corresponding recessed engaging portion to prevent detachment of the protrusions. Conversely, in other embodiments the first coupling portion 41 may include a recessed engaging portion and the second coupling portion 42 may include a corresponding protrusion configured to provide a snap-fit engagement. However, the construction of the first and second coupling portions 42 is not limited to the above-mentioned specifics, and any engaging and securing structures may be used for coupling the blade housing with its side caps.

The side caps 40 mainly serve to cover the blade housing 30 and fix the blades 20. Therefore, referring to FIG. 6, the side surface of each side cap 40 facing the blade housing 30 has a side cap recess 43 corresponding to the contour of each longitudinal end of the blade housing 30. The side caps 40 are configured to have top ends for covering the blade housing 30 when the ends of the blade housing 30 are inserted into the side cap recesses 43, as well as covering the blades 20 at their uppermost blade edges 21. To this end, each side cap recess 43 may have an upper inner surface formed in a shape corresponding to the contour of a part of the top surface of each longitudinal end of the blade housing 30. The side caps 40 when moving toward the blade housing 30 cover the blade edges 21 partially at both longitudinal ends of the blades 20 coupled to the seats 31. This prevents upward dislocation of the blades 20, and they can be more firmly fixed to the seats 31.

Figure 8:
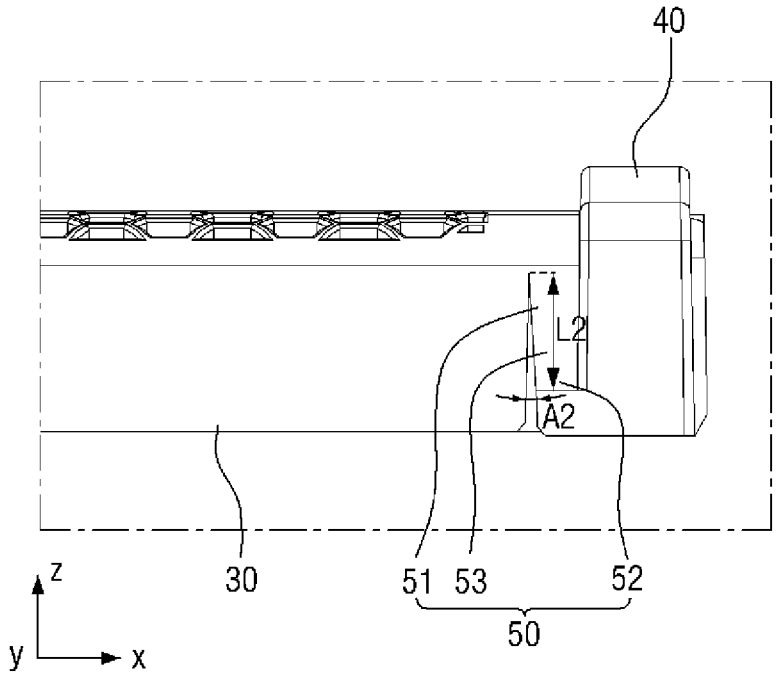
FIG. 8 is a side view of a razor cartridge according to at least one embodiment of the present disclosure after coupling of the side caps and the blade housing to the razor cartridge.

The following description, illustrated in FIGS. 7 and 8, is a process of coupling the blade housing 30 and the side cap 40 to each other so that the blades 20 are engaged with the cartridge according to at least one embodiment of the present disclosure. The process is described in terms of securing the side cap 40 to the blade housing 30 via the bridge 50.

FIG. 7 is a side view of the razor cartridge 10 according to at least one embodiment of the present disclosure before the side caps 40 and the blade housing 30 thereof are coupled, and FIG. 8 is a side view of the razor cartridge 10 according to at least one embodiment, after the side caps 40 and the blade housing 30 are coupled.

The blades 20 are inserted into the seats 31 located in the blade housing 30. At the time when the lower ends of the blades 20 are inserted into the seats 31, the blades 20 are not completely secured but only partially fixed at their lower ends to the seats 31.

A lateral surface of the blade housing 30 and each bridge 50 forms an initial angle A1 as shown in FIG. 7.

An external force applied externally to the side cap 40 toward the blade housing 30 causes a stress to be applied to the bridge 50 connecting the side cap 40 to the blade housing 30.

This leads to deformation of the bridge 50 at the first and second junctions 51 and 52 greater than that at the body 53. Due to the external force exerted on the outer surface of the side cap 40 toward the blade housing 30, the first junction 51 connected to the blade housing 30 undergoes deformation of a lengthwise contraction and an angular change with respect to the body 53. The second junction 52 may undergo deformation of a lengthwise contraction and an angular change with respect to the body 53, which deforms the second junction 52 to move in a direction approaching the blade housing 30.

In the present embodiment, the length of the bridge 50 is reduced in accordance with the deformation of the first junction 51 and the second junction 52. However, according to another embodiment, an external force applied deforms the first junction 51 and the second junction 52, and at the same time, deforms the bridge body 53 to reduce the overall length of the bridge 50, wherein the body 53 may be deformed more than the first junction 51 and the second junction 52. According to yet another embodiment, no contracting deformation occurs with the first junction 51, the second junction 52 and the body 53. In this case, the bridge 50 moves while rotating about the first junction 51 and is brought into a close contact with the side surface of the blade housing 30. Accordingly, the bridge 50 is diagonally oriented until an external force is applied externally of the side cap 40 to the blade housing 30, when the bridge 50 rotates and moves around the first junction 51. Since the bridges 50 are arranged symmetrically with respect to the blade housing 30, the direction of rotation and movement of the bridges 50 connected to one longitudinal side of the blade housing 30 is opposite to that of the bridges 50 connected to the other longitudinal side of the blade housing 30.

The bridge 50 is arranged diagonally toward the lower side of the side cap 40 until it rotates, allowing the bridge 50 finally to be positioned so as to be vertically aligned. In other words, the bridge 50 turns from its initial orientation in one of the directions excluding the direction perpendicular to the surface where the blade housing 30 comes in contact with the skin, i.e., excluding the z-axis direction, to its final orientation in the direction perpendicular to the surface where the blade housing 30 contacts the skin, i.e., the z-axis direction.

The side cap 40 is connected to the second junction 52 making it possible for the rotation of the bridge 50 to cause the side cap 40 to move along the rotation direction of the second junction 52 to approach the blade housing 30. The side cap 40 moves until the body 53 of the bridge 50 is brought into close contact with the blade housing 30. As much as the bridge 50 rotates about the first junction 51 into a close contact with the blade housing 30, the side cap 40 connected to the bridge 50 at the second junction 52 co-rotates about the first junction 51 until it is brought into close contact with the blade housing 30. In this process, each side cap recess 43 moves toward the blade edges 21, and the top end of the side cap recess 43 descends in the diagonal direction while covering the blade edges 21 of the blades 20. The opposite side cap recesses 43 cover the blade edges 21 and push the upper ends of the blade edges 21 downward (toward the seats 31), and they press and fix both longitudinal ends of the blade 20 to the longitudinal center of the housing 30. Thus, the side caps 40 allow the blades 20 to be more firmly fixed to the blade housing 30.

The process of drawing the side caps 40 under external forces close to the blade housing 30 causes the first coupling portions 41 of the blade housing 30 to be coupled with the second coupling portions 42 of the side cap 40 so that the coupling portions are forcibly fastened together. At this time, the first junction 51 and the second junction 52 may have a distance L2 which is shorter than a distance L1 between the first junction 51 and the second junction 52 before being subjected to an external force applied to the side cap 40. Therefore, each bridge 50, which is contracted from the original length, is sandwiched between the blade housing 30 and the side cap 40 and stresses the blade housing 30 at the upper end and the side cap 40 at the lower end. The stress applied by the bridges 50 enables the upper ends of the side cap recesses 43 partially covering the blade edges 21 of the blades 20 at both longitudinal ends while resting on the blade housing 30, to strongly press the blades 20 toward the seats 31. In addition, by variably shaping the portions where the side cap 40 presses the blades 20 or variably shaping the seats 31, the blades may get fixed in consideration of the characteristics such as the exposure value of the edge and the shaving angle for individual blades 20.

As can be seen in FIG. 8, the final angle A2 between the blade housing 30 and the bridge 50 is smaller than the initial angle A1 therebetween (A2<A1). Since the movement of the bridge 50 connected to the side cap 40 toward the blade housing 30 accompanies the coupling of the side cap 40 to the blade housing 30, the initial angle gets smaller in this process when bringing the second junction 52 of the bridge 50 to which the side cap 40 is connected, closer to the blade housing 30.

Hereinafter, a method for assembling the razor cartridge 10 according to at least one embodiment of the present disclosure will be described with reference to FIG. 9.

Figure 9:
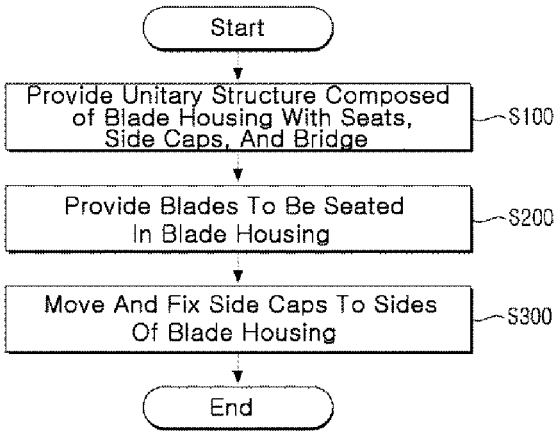
FIG. 9 is a flowchart of a method for assembling a razor cartridge according to at least one embodiment of the present disclosure.

FIG. 9 is a flowchart of a method for assembling a razor cartridge 10 according to at least one embodiment of the present disclosure.

A method for assembling the razor cartridge 10 according to at least one embodiment includes Step S100 of providing the razor cartridge 10 of a unitary structure having a blade housing 30 including integrally formed seats 31 into which one or more blades 20 are inserted, a pair of side caps 40 disposed on and spaced apart from both longitudinal ends of the blade housing 30, and bridges 50 for interconnecting the blade housing 30 and the side caps 40. The method further includes Step S200 of placing the blades 20 in the blade housing 30 at the seats 31, and Step S300 of moving the side caps 40 close to the blade housing 30 and fastening the side caps 40 to the blade housing 30, whereby securing the blades 20 to the seats 31 of the blade housing 30.

First, the unitary razor cartridge 10 including the blade housing 30, a pair of side caps 40, and the bridges 50 (S100) is provided. Since these components are integrally formed, they can be formed using the same material. However, the components may be integrally formed, and one of the components may be formed of a different material, thereby forming the single razor cartridge 10 made of different materials and qualities. A pair of side caps 40 are respectively arranged at the ends of the blade housing 30 with a clearance therebetween, and the bridges 50 interconnect the blade housing 30 and the side caps 40. The blade housing 30 includes the seats 31 into which the blades 20 are inserted, and the number of the seats 30 corresponds to the number of the blades 20 as described above.

Then, at least one or more blades 20 are provided, and the blades 20 are seated on the seats 31 (S200). There may be one blade 20, or a unit of a plurality of the blades 20. The lower ends of the blades 20 are inserted into the respective seats 31 and fixed thereto.

Subsequently, the side caps 40 are moved close and fixed to the blade housing 30 (S300). External forces are applied to the side caps 40 toward the blade housing 30 to forcibly move the side caps 40 toward the longitudinal ends of the blade housing 30, and the side caps 40 respectively come in contact with the longitudinal ends of the blade housing 30 while partially covering the top surfaces of the blade 20. A more detailed description of what happens in this step follows.

Figure 10:
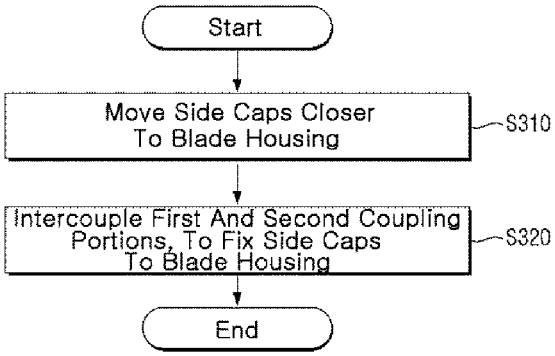
FIG. 10 is a flowchart of steps for moving the side caps closer to the blade housing and fastening them together during the assembling of the razor cartridge according to at least one embodiment of the present disclosure.

FIG. 10 is a flowchart of steps of moving the side caps 40 closer to the blade housing 30 and fastening them together during the assembly of the razor cartridge 10 according to at least one embodiment of the present disclosure.

The method of assembling the razor cartridge 10 according to at least one embodiment of the present disclosure, and in particular Step S300 of moving the side caps 40 close to the blade housing 30 and fastening them together, includes Step S310 of moving the side caps 40 close to the blade housing 30, and Step S320 of intercoupling the first coupling portions 41 disposed on the blade housing 30 and the second coupling portions 42 disposed on the side caps 40 to fix the side caps 40 to the blade housing 30.

External forces are applied to the side caps 40 toward the blade housing 30 so that the side caps 40 move closer to the blade housing 30 in Step S310.

As the bridges 50 contract, the first and second coupling portions 41 and 42 are coupled together as the side cap 40 approaches the corresponding side of the blade housing 30 (S320). The side caps 40 get more firmly fixed to the blade housing 30 as the first and second coupling portions 42 are intercoupled.

By contracting, the bridges 50 apply stress to the side caps 40 and the blade housing 30 so that the side caps 40 get more firmly fixed to the blade housing 30. The simple depression of the side caps 40 toward the blade housing 30 fastens the blades 20 to the blade housing 30, simplifying the assembly process of the razor cartridge 10.

The step of moving the side caps 40 close to the blade housing 30 includes the steps of moving the side caps 40 until they come in close contact with the blade housing 30, allowing the side cap recesses 43 to move toward the blade edge 21 and the upper portions of the side cap recesses 43 to descend diagonally to cover the blade edges 21 of the blades 20. The side cap recesses 43 cover the blade edges 21 while pushing the upper ends of the blade edges 21 downward (toward the seats 31) and press and fix both longitudinal ends of the blade edge 21 to the longitudinal center of the blade housing 30. Thus, the side caps 40 allow the blades 20 to get more firmly fixed to the blade housing 30.

In other words, the inner recesses 43 of the side caps 40 press the blade housing 30, allowing the coupling between the side caps 40 and the blade housing 30 to become more rigid.

Hereinafter, a top shape of a razor cartridge according to another embodiment of the present disclosure will be described with reference to FIG. 11.

Figure 11:
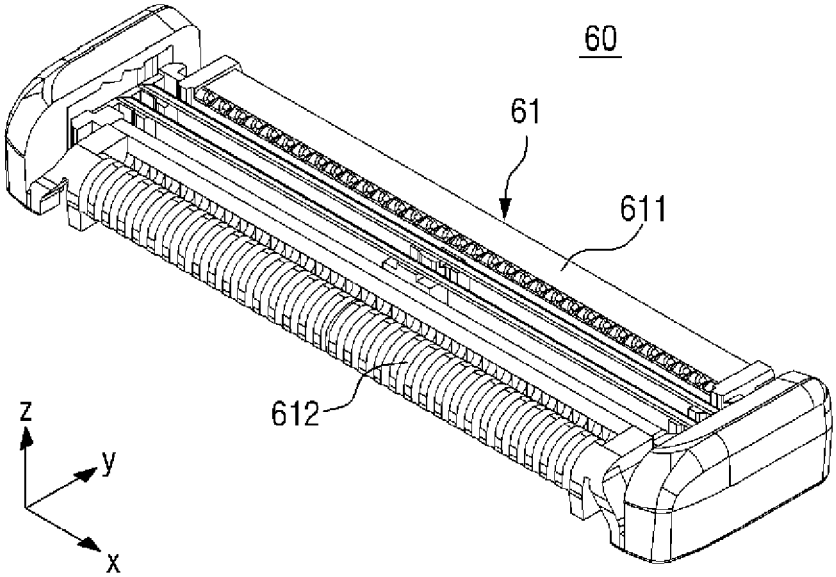
FIG. 11 is a perspective view of a guard shape of a razor cartridge according to another embodiment of the present disclosure.

FIG. 11 is a perspective view of a razor cartridge 60 installed with another type of guard 612 and a lubricating band 611, according to another embodiment of the present disclosure.

As in the above description provided with reference to FIG. 2, the top surfaces of the blade housing 61 are surfaces coming in contact with the skin on which body/facial hairs are formed, and they may be formed with various members capable of smooth shaving through skin contact. For example, hexagon-shaped holes are presented in FIG. 2. The razor cartridge 60 in FIG. 11 has a guard 612 formed on a top side surface of the blade housing 61, and a lubrication band 611 formed on the other side of the top surface of the blade housing 61.

As shown in FIG. 11, the guard 612 may have a curved surface in the form of a cylinder to let the blades to move smoothly when they come in contact with the skin, and it may have a surface patterned with comb-like fine irregularities to align the body/facial hairs to be cut. In addition, to perform such a function, the irregularities may be located in a position ahead of the blades in the shaving direction, to allow them to come in contact with the skin and the body/facial hairs before the blades do.

The lubrication band 611 may be made of a material that provides lubrication to the skin, so that the skin can be protected during the shaving/cutting. The lubrication band 611 may be arranged to extend flatwise in the longitudinal direction and on the top surface of the blade housing 61 so that the lubricant can be evenly applied to the skin by the lubrication band 611. Further, an additional lubrication band may be provided between the guard 612 and the blades 20 to provide the lubrication to the skin before the blades 20 come in contact with the skin.

It will be understood by those skilled in the art that the present disclosure may be embodied in other specific forms without departing from the technical idea or essential characteristics thereof. It is therefore to be understood that the above-described embodiments are illustrative in all aspects and not restrictive. The scope of the present disclosure is defined by the appended claims rather than the detailed description, and all changes or modifications derived from the meaning and scope of the claims and their equivalents are to be construed as being included within the scope of the present disclosure.

Although the present disclosure has been described in connection with the above-mentioned preferred embodiments, various modifications and variations can be made without departing from the idea and scope of the disclosure. Accordingly, it is intended that the appended claims cover all such modifications and variations as long as they fall within the idea of the disclosure.

The invention claimed is:

1. A razor cartridge comprising:

a blade housing including a seat configured to receive the at least one blade;

a pair of side caps respectively disposed at opposite ends of the blade housing, wherein each of the side caps is disposed at a corresponding one of the ends of the blade housing; and a plurality of bridges integrally connecting each of the side caps to the corresponding end of the blade housing such that the blade housing, the pair of side caps, and the plurality of bridges are integrally formed, wherein one or more of the bridges are disposed at each end of the blade housing and configured to be deformable between the side cap and the corresponding end of the blade housing, wherein each of the side caps is moveable relative to the blade housing via the deformable one or more bridges between a first position where the side cap is spaced apart from the corresponding end of the blade housing and a second position where the side cap is engaged with the corresponding end of the blade housing, wherein each of the side caps is configured to secure the at least one blade to the blade housing when the side caps are respectively engaged with the corresponding ends of the blade housing at the second position, and wherein a length of each of the one or more bridges is shortened when the side cap is moved from the first position to the second position.

2. The razor cartridge of claim 1, wherein each of the side caps comprises a recess configured to accommodate the corresponding end of the blade housing therein, and wherein the side cap is configured to cover an end of the at least one blade received in the seat when the side cap is engaged with the corresponding end of the blade housing at the second position.

3. The razor cartridge of claim 2, wherein a bridge of the plurality of bridges positioned at one end of the blade housing and another bridge of the plurality of bridges positioned at another end of the blade housing are rotated in opposite directions as the side caps are moved toward the second position.

4. The razor cartridge of claim 1, wherein each of the side caps is engaged with the corresponding end of the blade housing via an engagement coupling when the side cap is at the second position, and wherein the engagement coupling comprises an engagement protrusion interlocking with an engagement recess.

5. A razor cartridge comprising:

a blade housing including one or more blade seats;

one or more blades seated in the one or more blade seats;

a pair of side caps respectively disposed at opposite ends of the blade housing; and one or more bridges integrally connecting each of the side caps to a corresponding one of the ends of the blade housing such that the blade housing, the pair of side caps, and the one or more bridges are integrally formed, wherein the one or more blades are secured by engagement between the side cap and the corresponding end of the blade housing when each of the side caps is moved via the one or more bridges from a first position at which the side cap is spaced apart from the corresponding end of the blade housing to a second position at which the side cap is engaged with the corresponding end of the blade housing, and wherein the one or more bridges are configured to deform between the side cap and the corresponding end of the blade housing, such that a length of each of the one or more bridges is shortened, when the side cap is moved from the first position to the second position.

6. The razor cartridge of claim 1, wherein an angle between the blade housing and the bridge decreases when the side cap is engaged with the corresponding end of the blade housing at the second position.

7. The razor cartridge of claim 6, wherein a final angle between the blade housing and the bridge resulted when the side cap is engaged with the corresponding end of the blade housing at the second position is smaller than an initial angle between the blade housing and the bridge when the side cap is at the first position prior to the engagement of the side cap with the corresponding end of the blade housing.

* * * * *